US007421751B2

(12) United States Patent
Ruggiero

(10) Patent No.: US 7,421,751 B2
(45) Date of Patent: Sep. 9, 2008

(54) FOLDING KNIFE HAVING LOCKING PORTION, CLIP PORTION AND UNSHARPENED PROTRUSION

(75) Inventor: John V. Ruggiero, Annapolis, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 93 days.

(21) Appl. No.: 11/467,281

(22) Filed: Aug. 25, 2006

(65) Prior Publication Data

US 2007/0130778 A1 Jun. 14, 2007

Related U.S. Application Data

(60) Provisional application No. 60/751,618, filed on Dec. 8, 2005.

(51) Int. Cl.
*B26B 11/00* (2006.01)
*B26B 1/04* (2006.01)

(52) U.S. Cl. ..... 7/118; 7/151; 30/155; 30/161

(58) Field of Classification Search ..... 30/155–161, 30/286, 340, 342–334; 7/118–120, 151–156
See application file for complete search history.

(56) References Cited

U.S. PATENT DOCUMENTS

| | | | | | |
|---|---|---|---|---|---|
| 300,858 | A * | 6/1884 | Feicker | 7/168 |
| 1,039,260 | A * | 9/1912 | Cooper | 7/118 |
| 1,290,228 | A * | 1/1919 | Kemp | 30/32 |
| 1,562,429 | A * | 11/1925 | Unsinger | 30/2 |
| 4,347,665 | A * | 9/1982 | Glesser | 30/161 |
| 4,651,419 | A * | 3/1987 | Reed, Jr. | 30/152 |
| 5,511,310 | A * | 4/1996 | Sessions et al. | 30/161 |
| 6,397,477 | B1 * | 6/2002 | Collins | 30/161 |

* cited by examiner

*Primary Examiner*—Kenneth E Peterson
*Assistant Examiner*—Phong Nguyen
(74) *Attorney, Agent, or Firm*—John J Karasek; Suresh Koshy

(57) ABSTRACT

A knife comprises a handle and a blade movably attached to the handle and having a sharpened side and an unsharpened side. The sharpened side has a first sharp portion and a second sharp portion. The blade is operable to move from an engaged position to a disengaged position and to move from the disengaged position to the engaged position. When the blade is positioned in the engaged position, the first sharp portion is uncovered by the handle and the second sharp portion is covered by the handle. When the blade is positioned in the disengaged position, the first sharp portion is covered by the handle and the second sharp portion is uncovered by the handle.

6 Claims, 2 Drawing Sheets

FOLDING KNIFE HAVING LOCKING PORTION, CLIP PORTION AND UNSHARPENED PROTRUSION

CROSS-REFERENCE TO RELATED APPLICATIONS

This application claims the benefit of priority under 35 U.S.C. § 119(e) to provisional patent application Ser. No. 60/751,618, filed Dec. 8, 2005, the entire disclosure of which is incorporated herein.

BACKGROUND OF THE INVENTION

The present invention is generally directed to the field of folding pocket knives. Tactical folding pocket knives (tactical folders) are a genre of blades designed specifically for ease of use and practicality in strenuous situations. Most tactical folders have thumb studs or grooves for ease of opening, pocket clips for ease of access and involve a locking mechanism that can be opened with one hand.

Many conventional folding pocket knives have locking mechanisms that prevent the blade from closing until the user desires. Many locking mechanisms for folding knives involve a first mechanism for preventing the knife from closing, and a second mechanism or part to halt the knife from opening beyond its desired point (over-opening). One of the more popular conventional locking mechanism is a liner lock mechanism, which includes a metal bar that is disposed within the handle of the folding pocket knife. The space in the handle of the folding pocket knife is sufficiently wide to house the folded blade and the metal bar. When the knife is unfolded such that the blade is in a position of use, the bar is operable to move laterally within the space to prevent the blade from retracting. In order to close the blade again, the bar must be pushed back across the space, which requires the user to place his or her thumb in the line of blade rotation. Obviously this procedure increases the likelihood of accidental injury to the knife user.

One of the most common ways for people to break knives is by using the blade for prying. Although a blade is not made for this purpose, sometimes the blade is the only tool available and must be used.

Tactical folding knives are often utilized in close proximity to other personnel or penetrable objects for simple cutting tasks such as cutting chord or opening boxes.

Most conventional clip systems on knives are simple pieces of steel or plastic that apply pressure against the handle in order to provide friction against movement. This friction must be overcome by force (vice rotation) for most knives. Conventional clip systems are either easy to access or secure when in use, but rarely both.

What is needed is a folding pocket knife that include a sturdy prying portion.

What is additionally needed is a folding pocket knife that enables simple cutting applications in without unfolding the blade.

What is additionally needed is a locking mechanism for a folding pocket knife that does not require the user to place his or her thumb in the line of blade rotation.

What is additionally needed is folding pocket knife having a clip that is both easy to access and secure when in use.

BRIEF SUMMARY OF THE INVENTION

It is an object of the present invention to overcome the problems associated with conventional folding pocket knives.

It is another object of the present invention to provide a folding pocket knife that fulfills the needs discussed above.

The present invention is generally drawn to a knife having handle portion and a foldable blade portion that is operable to move from an engaged position to a disengaged position and to move from the disengaged position to the engaged position.

In one aspect of the invention, the blade portion has a first sharp portion and a second sharp portion. When the blade portion is positioned in the engaged position, the handle portion does not cover the first sharp portion and the handle portion covers the second sharp portion. When the blade portion is positioned in the disengaged position, the handle portion covers the first sharp portion and the handle portion partially covers the second sharp portion thereby preventing unwanted cutting but permitting desired cutting.

The purpose of the second sharp portion is to cut small items without opening the blade. This is safer than placing the blade portion in the engaged position, especially in tight quarters and near penetrable objects. It is also useful as an expedient way to place the blade portion in the engaged position.

In another aspect of the invention, the blade portion has an unsharpened protrusion. When the blade portion is positioned in the engaged position, the handle portion covers the unsharpened protrusion. When the blade portion is positioned in the disengaged position, the handle portion does not cover the unsharpened protrusion.

The purpose of the unsharpened protrusion is to extend from the handle portion when closed and provide a tool for operations other than cutting, non-limiting examples of which include prying or hitting, that will not break as easily as the tip of a blade would. The unsharpened protrusion can be used for prying operations more safely (less likelihood of breakage) than a regular blade since it is shorter and thicker. Further, the unsharpened protrusion can be used to strike objects as necessary. Still further, when the blade portion is in the engaged position, the prying protrusion provides a larger area under the handle, which would make the blade portion stronger if the uncovered blade portion were used for prying or similar operations. Beyond this, the prying protrusion can also be to assist in moving the blade portion to the engaged position, for example by leveraging the protrusion against one's pant pocket or leg.

In another aspect of the invention, the blade portion has an unsharpened protrusion and is used in conjunction with a locking portion having a first end and a second end. The first end of the locking portion has a first lip and is movably attached to the handle portion. The second end of the locking portion has a second lip and is revolvable about the first end. The blade portion is operable to move in a first direction from the engaged position to the disengaged position and to move in a second direction from the disengaged position to the engaged position. When the blade portion is positioned in the engaged position, the unsharpened protrusion is disposed between the first lip and the second lip such that the blade portion is unable to move in the second direction or the first direction.

The locking portion has the advantage of halting both an opening and closing motion of the blade portion with one object. As discussed earlier, many locking mechanisms involve a first mechanism for preventing the knife from closing, and a second mechanism or part to halt the knife from opening beyond its desired point (over-opening). A "stop pin," which is generally used to prevent the knife from over-opening, would not allow a blade with a prying protrusion to function. In the present invention, the combination of the locking portion and unsharpened protrusion has a large mechanical advantage over conventional locking mechanisms. Since the lock portion of the present invention operates in conjunction with the end of the prying protrusion, it is considerably farther from the axis of rotation of the blade than conventional locking mechanisms. For this reason, less force is required from the lock to prevent motion in either direction with any given force on the blade.

In another aspect of the invention, a clip portion having a first area and a second area is movably attached to the handle portion at the first area. The clip portion is operable to move from a hold position to a released position and to move from the released position to the hold position. When the clip portion is positioned in the hold position, the second area is in biased contact with the handle portion. When the clip portion is positioned in the released position, the second area is in a less biased contact, or not in contact, with the handle portion.

The clip portion allows the knife to be very tightly secured, and be concurrently very easily accessible. The purpose of the clip system is to have very strong grip when closed, for example onto someone's pocket, but to have very weak grip when opened in the process of retrieving the knife. This allows for secure carry and ease of accessibility. Also, when the clip is rotated open it provides an extra surface to which to grab the knife.

Additional objects, advantages and novel features of the invention are set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an exemplary embodiment of the present invention and, together with the description, serve to explain the principles of the invention. It is noted that the exemplary embodiment is drawn to iris recognition. However novel aspects of the present invention are not limited in this scope. On the contrary, the novel aspects of the present invention can additionally be drawn to retina recognition or recognition of any parameter that can be imaged. In the drawings.

DETAILED DESCRIPTION OF THE INVENTION

Figure 1:
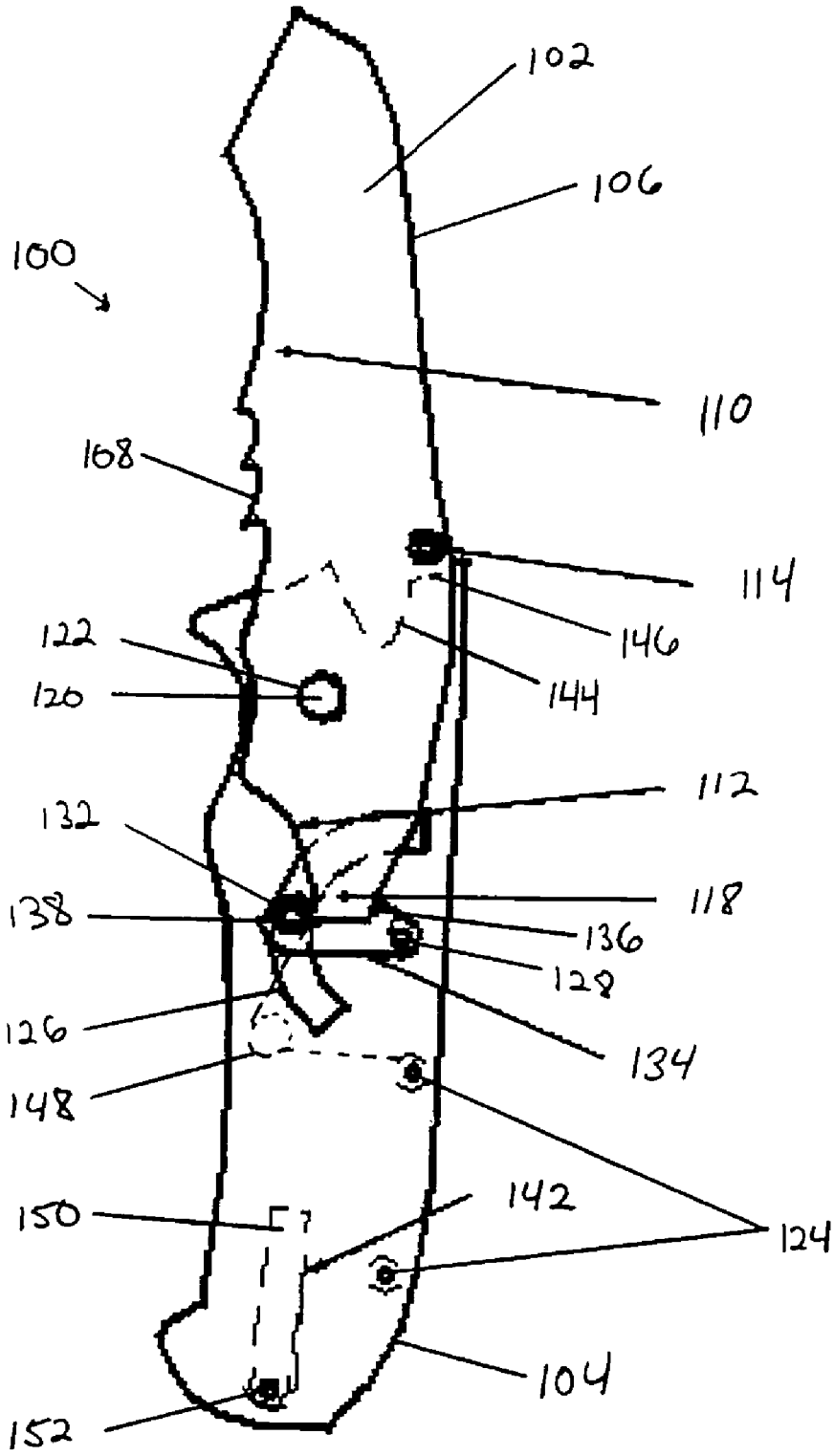
FIG. 1 is a side view of an exemplary embodiment of a folding knife in the engaged position in accordance with the present invention.

As illustrated in FIG. 1, a knife 100 includes a blade portion 102 and a handle portion 104.

Blade portion 102 includes an unsharpened side 106 used for folding blade portion 102 closed (or into a disengaged position). Blade portion 102 may further include: a sharp side 108 that has a first sharp portion 110 and a second sharp portion 112; a thumb stud 114; and an unsharpened protrusion 118. Blade portion 102 may also have a hole 120 therein, wherein a pin 122 may be used to pivotally attach blade portion 102 to handle portion 104. Rivets 124 attach two halves of handle portion 104 together.

Handle portion 104 has a groove 126 therein in which a cam pin 132 is operable to move. Cam pin 132 is movably attached to handle portion 104, for example via a biased spring or torsion element 148 at one of rivets 124.

A locking portion 134 has a first end and a second end. The first end has a first lip 136 and is rotatably attached to handle portion 104, for example, via a pin 128. The second end of locking portion 134 has a second lip 138, which engages cam pin 132. Accordingly, as cam pin 132 moves about groove 126, second lip 138 revolves about pin 128 thus rotating locking portion 134.

In the engaged position, first sharp portion 110 is not covered by handle portion 104 whereas second sharp portion 112 is covered by handle portion 104. Further, unsharpened protrusion 118 is engaged with locking portion 134 such that the sides of unsharpened protrusion 118 are bounded by first lip 136 and second lip 138. Accordingly, blade portion 102 is unable to move in either direction. Until the user releases locking portion 134 by moving cam pin 132 about groove 126 so as to disengage lip 138 from unsharpened protrusion 118, blade portion 102 cannot move. As such, a user may unlock and then close blade portion 102 without placing a thumb in the line of blade rotation. In addition to assisting the user to open blade portion 102, i.e., place blade portion 102 into the engaged position, thumb stud 114 is a protrusion on blade portion 102 that rests against handle portion 104 at resting surface 146. Thumb stud 114 therefore further prevents "over-opening" of blade portion 102.

A clip portion 142 is additionally movably attached to handle portion 104, for example via a pin 152. An end portion 150 of clip portion 142 is in biased contact with handle portion 104.

Figure 2:
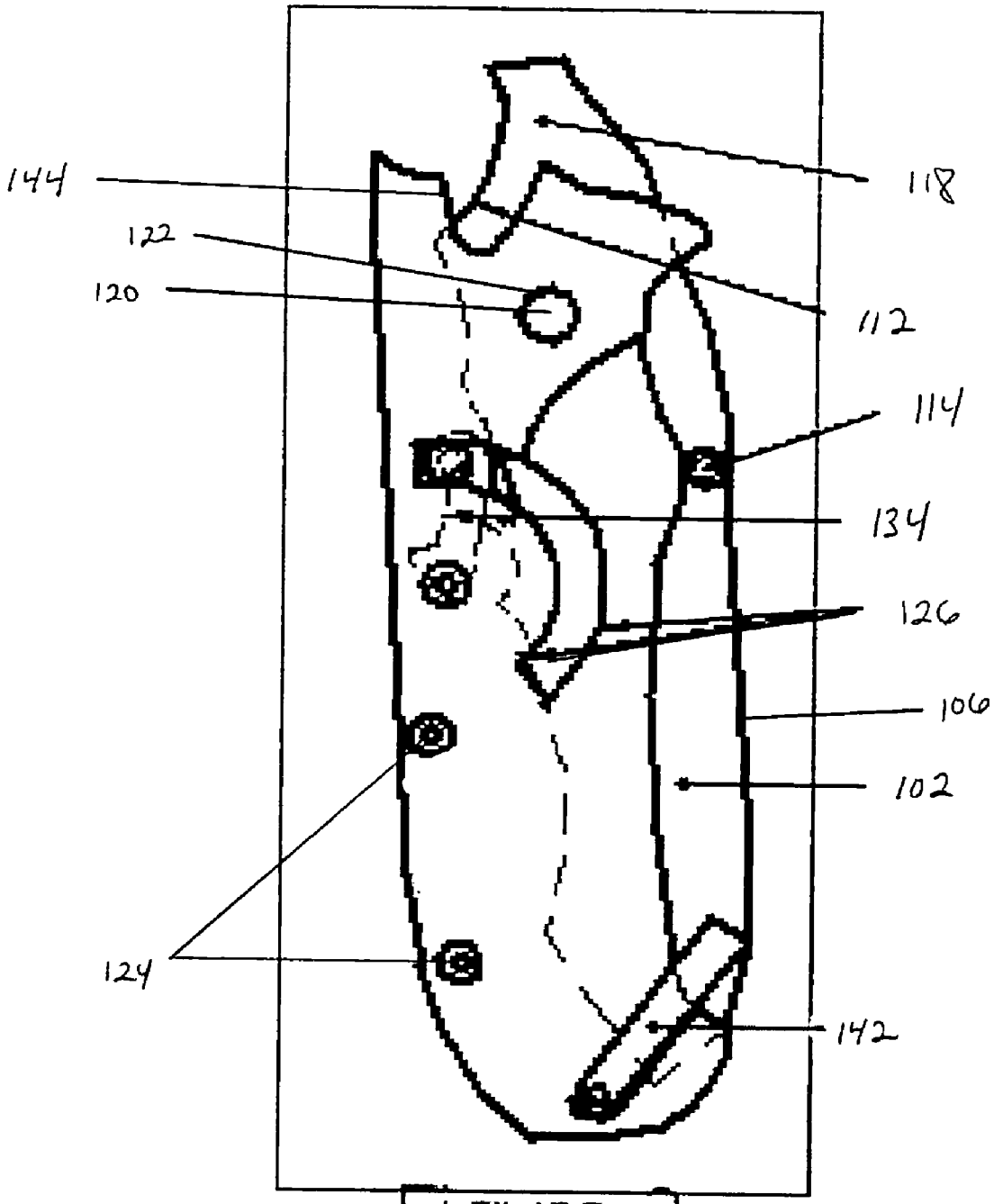
FIG. 2 is a side view of the folding knife of FIG. 1 in the disengaged position.

FIG. 2 is a side view of the folding knife 100 of FIG. 1 in the disengaged position. In the disengaged position, first sharp portion 110 is covered by handle portion 104 whereas second sharp portion 112 is not covered by handle portion 104 via notch 144 in handle portion. Further, unsharpened protrusion 118 is not engaged with locking portion 134. In this disengaged position, unsharpened protrusion 118 can be used for striking and prying operations, and can further be pressed to induce opening of knife 100, i.e. placing into engaged position. Still further, second sharp portion 112 can be used to cut small objects such as chord and cloth.

Operation of the exemplary embodiment illustrated in FIGS. 1 and 2 will now be discussed.

Clip portion 142 may be considered engaged when it is disposed over handle portion 104 as in FIG. 1. By rotating end portion 150 about pin 152, clip portion 142 may be in less biased contact with handle portion 104, or alternatively not in contact with handle portion 104 as illustrated in FIG. 2. In another embodiment, rotation of end portion 150 about pin 152 may be limited by a protruding surface of handle portion 104.

When blade portion 102 is closed and locking portion 134 is disengaged as illustrated in FIG. 2, locking portion 134 rests at a first end of groove 126 due to the upward force of torsion element 148.

When blade portion 102 is opened, unsharpened protrusion 118 forces locking portion 134 to rotate along groove 126 via cam pin 132. The opening motion of blade portion 102 is halted initially by thumb stud 114, wherein blade portion 102 is in a position more rearward than it will be in its final state (as illustrated in FIG. 1). Torsion element 148 forces locking portion 134 locking mechanism upward and leads unsharpened protrusion 118 into the area bounded by first engaging lip 136 and second engaging lip 138 of locking portion 134. At this point, lips 136 and 138 and the biased force of torsion element 148 work together to keep blade portion 102 from disengaging from locking portion 134.

In order to close blade portion 102, locking portion 134 disengaged by rotating cam pin 132 downward. At this point, blade portion 102 is will be free to rotate and close.

The foregoing description of various preferred embodiments of the invention have been presented for purposes of illustration and description. It is not intended to be exhaustive or to limit the invention to the precise forms disclosed, and obviously many modifications and variations are possible in light of the above teaching. The exemplary embodiments, as described above, were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A knife comprising:

a handle portion;

a blade portion movably attached to said handle portion and having a sharp portion and an unsharpened protrusion; and a locking portion having a first end and a second end, said first end having a first lip and being rotatably attached to said handle portion, said second end having a second lip and being revolvable about said first end, wherein said blade portion is operable to move from an engaged position to a disengaged position and to move from the disengaged position to the engaged position, wherein when said blade portion is positioned in the engaged position, said sharp portion is uncovered by said handle portion and said unsharpened protrusion is covered by said handle portion, wherein when said blade portion is positioned in the disengaged position, said sharp portion is covered by said handle portion and said unsharpened protrusion is uncovered by said handle portion, wherein said blade portion is operable to move in a first direction from the engaged position to the disengaged position and to move in a second direction from the disengaged position to the engaged position, and wherein when said blade portion is positioned in the engaged position, said unsharpened protrusion is disposed between said first lip and said second lip such that said blade portion is unable to move in the second direction or the first direction.

2. The knife of claim 1, further comprising:

a clip portion having a first area and a second area, said clip portion being movably attached to said handle portion at said first area, said clip portion being operable to move from a hold position to a released position and to move from the released position to the hold position, wherein when said clip portion is positioned in the hold position, said second area is in biased contact with said handle portion, and wherein when said clip portion is positioned in the released position, said second area is not in biased contact with said handle portion.

3. A knife comprising:

a handle portion;

a blade portion movably attached to said handle portion and having a sharpened side and an unsharpened side, said sharpened side having a first sharp portion and a second sharp portion; and a locking portion being moveably attached to said handle portion, wherein said blade portion is operable to move from an engaged position to a disengaged position and to move from the disengaged position to the engaged position, wherein when said blade portion is positioned in the engaged position, said first sharp portion is uncovered by said handle portion and said second sharp portion is covered by said handle portion, wherein when said blade portion is positioned in the disengaged position, said first sharp portion is covered by said handle portion and said second sharp portion is uncovered by said handle portion, wherein said blade portion further has an unsharpened protrusion, wherein when said blade portion is positioned in the engaged position, said unsharpened protrusion is covered by said handle portion, wherein when said blade portion is positioned in the disengaged position, said unsharpened protrusion is uncovered by said handle portion, wherein said locking portion includes a first end and a second end, said first end having a first lip and being rotatably attached to said handle portion, said second end having a second lip and being revolvable about said first end, wherein said blade portion is operable to move in a first direction from the engaged position to the disengaged position and to move in a second direction from the disengaged position to the engaged position, and wherein when said blade portion is positioned in the engaged position, said unsharpened protrusion is disposed between said first lip and said second lip such that said blade portion is unable to move in the second direction or in the first direction.

4. The knife of claim 3, further comprising:

a clip portion having a first area and a second area, said clip portion being movably attached to said handle portion at said first area, said clip portion being operable to move from a hold position to a released position and to move from the released position to the hold position, wherein when said clip portion is positioned in the hold position, said second area is in biased contact with said handle portion, and wherein when said clip portion is positioned in the released position, said second area is not in biased contact with said handle portion.

5. A knife comprising:

a handle portion;

a blade portion movably attached to said handle portion and having a sharpened side and an unsharpened side, said sharpened side having a first sharp portion and a second sharp portion; and a locking portion having a first end and a second end, said first end having a first lip and being rotatably attached to said handle portion, said second end having a second lip and being revolvable about said first end, wherein said blade portion is operable to move from an engaged position to a disengaged position and to move from the disengaged position to the engaged position, wherein when said blade portion is positioned in the engaged position, said first sharp portion is uncovered by said handle portion and said second sharp portion is covered by said handle portion, wherein when said blade portion is positioned in the disengaged position, said first sharp portion is covered by said handle portion and said second sharp portion is uncovered by said handle portion, wherein said blade portion further has an unsharpened protrusion, wherein said blade portion is operable to move in a first direction from the engaged position to the disengaged position and to move in a second direction from the disengaged position to the engaged position, and wherein when said blade portion is positioned in the engaged position, said unsharpened protrusion is disposed between said first lip and said second lip such that said blade portion is unable to move in the second direction or the first direction.

6. The knife of claim 5, further comprising:

a clip portion having a first area and a second area, said clip portion being movably attached to said handle portion at said first area, said clip portion being operable to move from a hold position to a released position and to move from the released position to the hold position, wherein when said clip portion is positioned in the hold position, said second area is in biased contact with said handle portion, and wherein when said clip portion is positioned in the released position, said second area is not in biased contact with said handle portion.

* * * * *